US007946201B2

(12) United States Patent
Frazer

(10) Patent No.: US 7,946,201 B2
(45) Date of Patent: May 24, 2011

(54) DISCRETE MULTITOOL LOCKING METHOD AND APPARATUS

(75) Inventor: Spencer Frazer, Lynnwood, WA (US)

(73) Assignee: SOG Specialty Knives & Tools, LLC, White Plans, NY (US)

( * ) Notice: Subject to any disclaimer, the term of this patent is extended or adjusted under 35 U.S.C. 154(b) by 0 days.

(21) Appl. No.: 11/692,799

(22) Filed: Mar. 28, 2007

(65) Prior Publication Data

US 2008/0236210 A1 Oct. 2, 2008

(51) Int. Cl.
*B25B 7/00* (2006.01)
*B25G 1/08* (2006.01)

(52) U.S. Cl. ..... 81/427.5; 81/177.4; 7/128

(58) Field of Classification Search ..... 081/427.5, 081/440, 177.4, 490; 030/152, 159–161; 007/118, 128, 125
See application file for complete search history.

(56) References Cited

U.S. PATENT DOCUMENTS

| | | | | |
|---|---|---|---|---|
| 97,154 | A * | 11/1869 | Barnard et al. | 7/118 |
| 4,238,862 | A * | 12/1980 | Leatherman | 7/128 |
| 6,233,769 | B1 * | 5/2001 | Seber et al. | 7/128 |
| 7,140,110 | B2 * | 11/2006 | Lake | 30/160 |
| 2003/0140740 | A1 * | 7/2003 | Rivera | 81/124.4 |

* cited by examiner

*Primary Examiner* — Hadi Shakeri
(74) *Attorney, Agent, or Firm* — Brian G Forrest; Hughes Law Firm, PLLC

(57) ABSTRACT

A locking system for a multitool where multiple discrete lock members are attached to a handle and the lock members can be individually engaged to lock and unlock tool members from a retained to an extended position and vice versa within the handle of a multitool.

10 Claims, 7 Drawing Sheets

DISCRETE MULTITOOL LOCKING METHOD AND APPARATUS

BACKGROUND

Multi-tools are utilized in a variety of forms and generally have jaw members which can be pliers, shearing members or a variety of other types of tools for various operations where the jaw member portion is foldable into the handle. The handles further house various tool members in one or both of the handles.

The tool members, such as a blade, can have a locking feature so the blade locks in an open orientation, similar to a regular foldable knife. Generally, multi-tools have at least two tool members positioned adjacent to one another and pivotally mounted to one of the handles. In some forms, there is friction between these tool members, which transfers torsional force from one moving tool member to an adjacent tool member. In other words, as one tool member changes position from a retained orientation to an extended orientation, as one tool member opens, the adjacent tool member is induced to open as well.

Of course, there are other issues with present multi-tools, and in particularly locking systems. Oftentimes one form of a locking system is a laterally extending bar-like member engaging all of the tool members within the handle at the base region, where there are various notches to engage the single laterally extending extension. Of course, this type of structure disengages from all of the notches of the tool members simultaneously. Therefore, described below is an apparatus and method for selectively locking and engaging a tool cam surface of various tools.

SUMMARY OF THE DISCLOSURE

Disclosed here in is a multi-tool having a jaw region with first and second jaw members. A first pivot is provided that is swingably connecting the jaw members for movement relative to each other, each of the jaw members having a working end portion extending from the first pivot in a first direction and a tail portion extending from the first pivot in a second, generally opposite direction.

The first and second handle members each have a channel region where the jaw members being moveable relative to the handles between an open position in which the jaw member working end portions are exposed and a closed position in which the jaw members are substantially nested in the channels of the handles. In one form channel regions of the handles opening outward, away from each other, when the handles are in the open position.

The first and second tool members are pivotally attached to the first handle member. Each tool member has an outer region and an attachment region. Located at the attachment region is a tool cam surface comprising a retaining surface and a lock member surface.

A tool member locking system is provided and has at least two lock members attached to the at least one handle member. Each lock member has a lock extension operatively configured to engage the tool cam surface of the first and second tool members. In one form the tool members are positioned adjacent to one another where the lock extension of the lock member engages the retaining surface to retain the tool member in a retained position within the central region of the first handle member. The lock extension is also operatively configured to engage the lock member surface to lock the of tool member to an extended orientation.

In one form the retaining surface and the lock member surfaces are notches extending radially inwardly from the adjacent tool cam surface.

A spring assembly is attached to the first handle member in one mode of caring out the embodiment and the spring assembly comprising first and second spring members each engaging the first and second lock members to bias the lock extension to the tool cam surface the spring assembly. In this form the first and second spring members can be cantilevered springs a substantial amount of the springing action for the first and second lock members from the spring assembly is from two independent lock member springs attached to a base region of the spring assembly.

The tool cam surface can have an intermediate lock notch to position an outer region of the first tool member in a locked orientation between an extended orientation and the retained orientation. This intermediate lock notch positions the outer portion of the first tool member at a substantially orthogonal orientation with respect to the first handle member.

The first and second lock bars can be defined as having a lock body having a spring engagement region configured to engage the first and second lock member springs.

The first lock member as described above pressed at an engagement surface and the lock extension of the first lock member disengages from the retaining surface of the first tool member, the lock extension of the second lock member maintains engagement with the retention surface of the second tool member where when the first tool reorientates from a retained orientation to an extended orientation with friction occurring between the first and second tool members.

In another embodiment, the retaining surface comprises a forward surface that is angled so the tool member can be extracted by way of placing a force on an extraction surface and the retention surface repositions the lock extension in a transverse outward direction.

DESCRIPTION OF THE PREFERRED EMBODIMENTS

Figure 1:
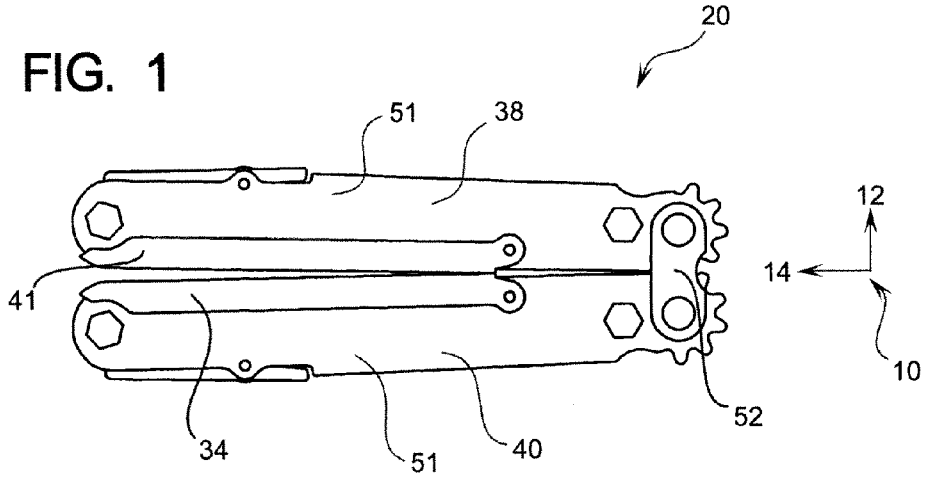
FIG. 1 shows a side profile view of a multitool in a closed position.
Figure 4:
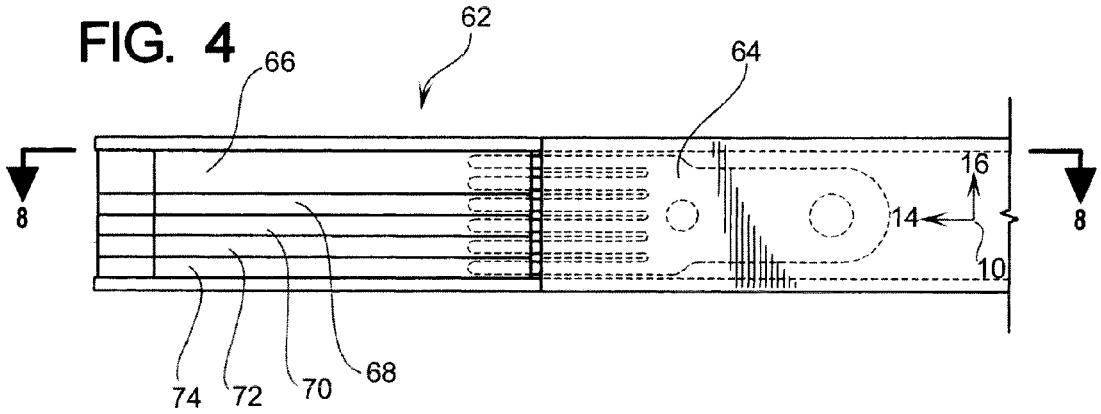
FIG. 4 shows the view of the locking system taken along line 4-4 of FIG. 3.

As shown in FIG. 1, there is shown a multitool 20. Before going into further discussion of the multitool 20, there will first be a description of a reference axis system to aid in the description of the embodiments. As shown in FIG. 1, the axis system 10 comprises a transverse axis 12 and a longitudinal axis 14. Further, the axis which is orthogonal to the axes 12 and 14 is the lateral axis 16 as shown in FIG. 4 at 16.

Figure 2:
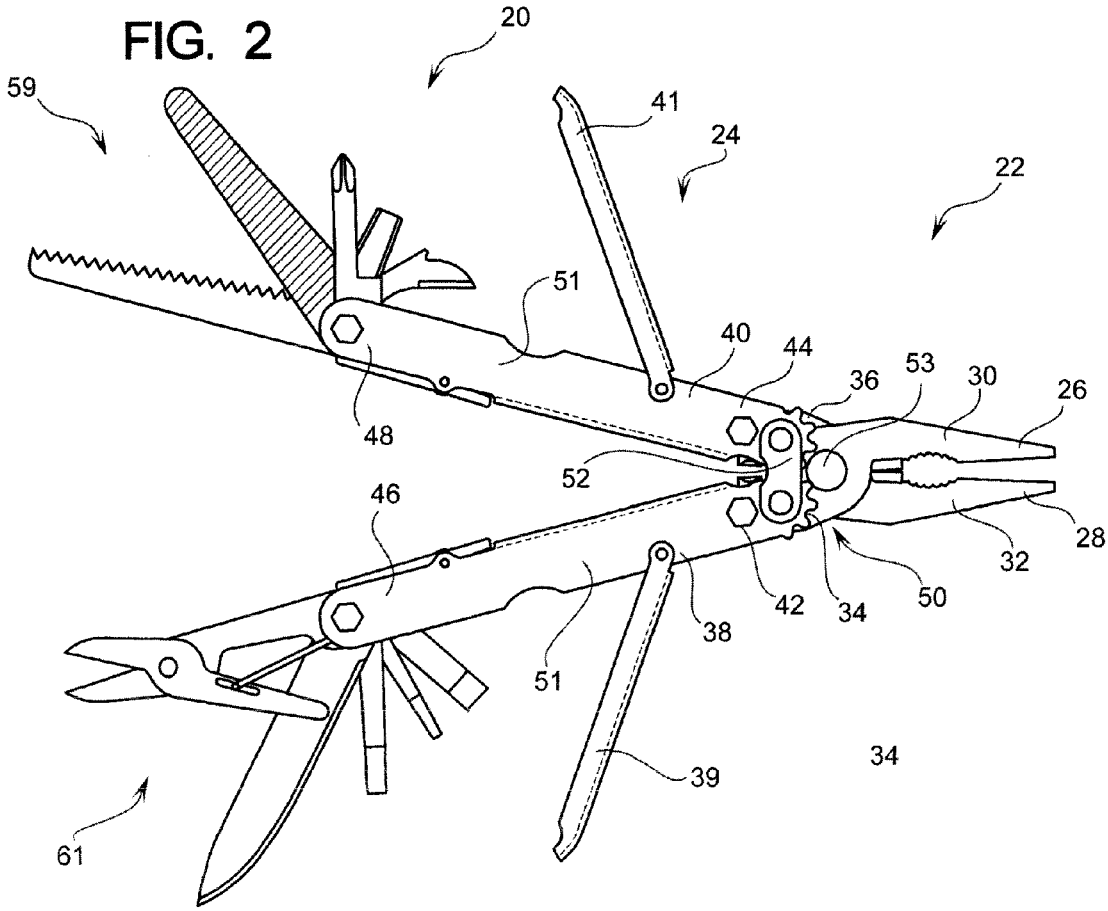
FIG. 2 shows a multitool in an open orientation with various tool members fully and partially extended from the channel region of the first and second handle members.

As shown in FIG. 2, the multitool 20 is shown with various tools position in a non-retained orientation. The multitool 20 comprises the jaw region 22 and the handle region 24. The jaw region 22 comprises first and second jaw members 26 and 28. In general, the jaw members have an operating region 30 and 32 referred to as a working end portion and a tail region 34 and 36.

The handle region 24 comprises first and second handle members 38 and 40, which in one form have protective covers 39 and 41. The handle members 38 and 40 have a central region 42 and 44 and an outward region 46 and 48. The wall portion 49 connects the lateral wall members 51, as shown in FIG. 3

The tail regions 34 and 36 of the first and second jaw members 26 and 28 are connected to the first and second handle members 38 and 40 at the central regions 42 and 44. In one form, this connection is by way of a linkage system 50 having a connection bar 52 and the central regions provide a gear system with forward surfaces defining meshing gears to provide compound leverage. This is one form of providing a jaw region and a handle region connection system. Of course, the central regions 42 and 44 could also be connected, usually by way of a pivotal attachment to the tail regions 34 and 36 of the jaw members. The full description of one form of the linkage system 50 is described in U.S. Pat. Nos. 6,003,180, 6,070,504, and 6,282,997, which are incorporated by reference.

Before getting into a detailed description of the locking system, reference is made to FIG. 1, where the handles 38 and 40 are in a closed orientation and the first and second jaw members are contained within the channel region 55 (see FIG. 3) within the handle members. As shown in FIG. 2 there is a first pivot 53 otherwise referred to as a jaw pivot which is a pivot member extended to the lateral direction. This pivot can be a separate pin member or be a more integral component with one of the jaw members.

Figure 3:
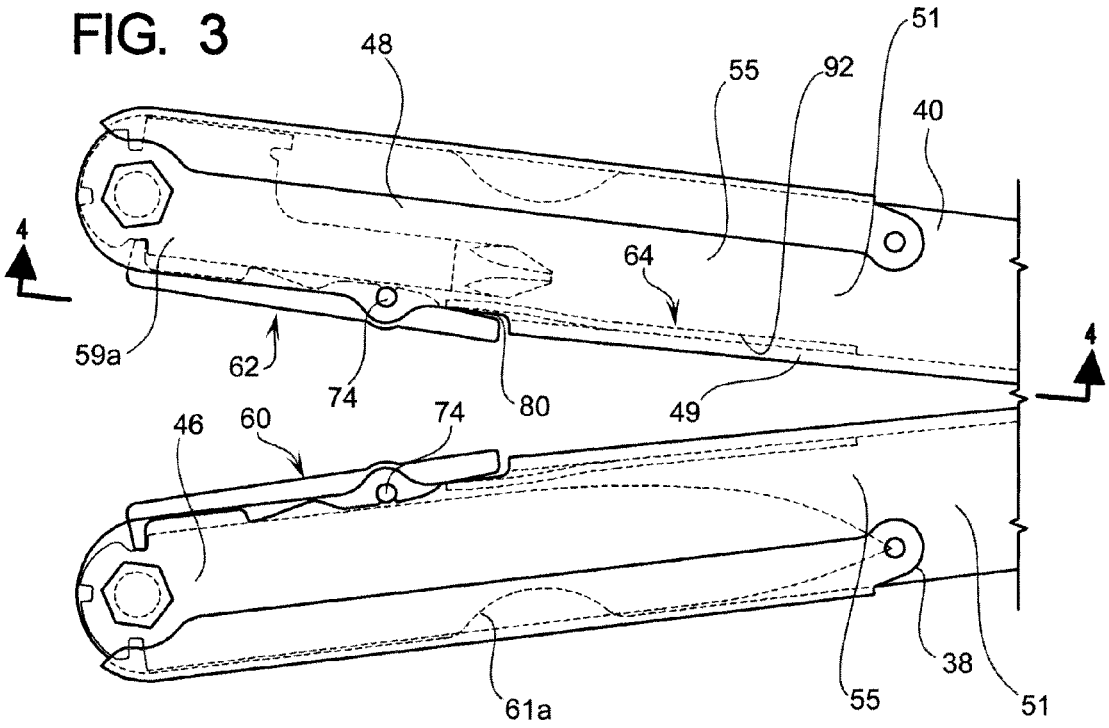
FIG. 3 shows a close-up view of the handle members in the open orientation where the tool members are shown as a hatched hidden line.

Referring now to FIG. 3, there is shown a close-up view of the outward regions 46 and 48 of the handles 38 and 40. As shown in this figure, there is a profile view of a first and second locking system 60 and 62.

FIG. 2 shows a plurality of tools 59 and 61. It should be noted that individual tool members are described in detail herein with an alpha character positioned following the number (e.g. 59*a*, 59*b*, etc.).

As shown in FIG. 4, there is a view of the locking system (in one form referred to as the second locking system) 62 which shows one embodiment of a tool locking system. In general, the locking systems (60 and 62 if two locking systems are employed) comprise a plurality of lock members (66-74 as shown in FIG. 4) and a spring assembly 64. FIG. 3 shows the tool members 59*a* and 61*a*, shown in a hatched line. FIG. 4 shows the locking system 62 where a plurality of lock members 66, 68, 70, 72 and 74 are positioned. It should be noted that FIG. 4 is taken along line 4-4 of FIG. 3 so the outward portions of the lock members 66-74 are shown. As further shown in FIG. 4, there is a spring assembly 64 described further herein.

Figure 5A:
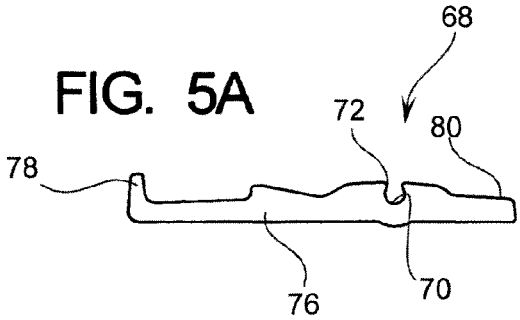
FIGS. 5A-5B show side and front views of a lock member.
Figure 5B:
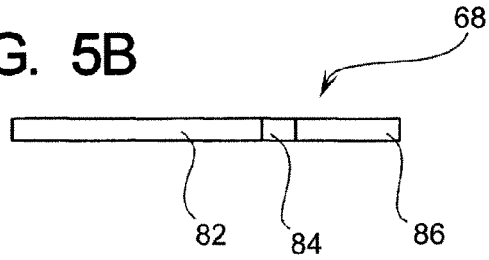

Referring now to FIGS. 5A and 5B, there will be a description of one form of a lock member indicated at 68. Of course, the lock members can be formed of a variety of shapes and contours; however, FIGS. 5A-5B show one form of a unitary type of lock member As shown in FIG. 5A, lock member 68 comprises a pivot attachment location 70. In one form, the attachment location is a surface defining an opening 72, where for assembly purposes the lock member can be snapped around a pin 74 such as that shown in FIG. 3. Referring back to FIG. 5A, the lock member 68 further comprises a lock body 76. As noted above, the lock member can be a unitary structure made from a single material, such as metal. At a forward portion of the lock body 76 is a lock extension 78 which generally extends in the transverse direction to engage various notches of the tool cam surface 104 of the tool members described herein. At the opposing longitudinal region is a spring engagement region 80 with a spring engagement surface to engage the lock member springs 90. Further, a transverse inward extension is provided, which in one form is useful for maintaining the orientation of the tool members where the tool members closer to the base region of the tool member would engage the extension positioned inwardly along the lock body 76.

Referring now to FIG. 5B, positioned in the transverse outward surface 82 is a tactile portion 84 which in one form protrudes outwardly. A tactile portion can be useful to indicate the pivot attachment location 70 so the operator can identify the release surface 86. When the lock member 68 is utilized in a first-degree lever-like orientation, the release surface 86 is positioned on the opposing longitudinal region of the pivot attachment location 70 with respect to the lock extension 78. As will become more apparent herein with the description of FIGS. 8-14, in one form, the lock member is a first-degree lever-like mechanism for disengaging the lock extension 78 from the tool cam surface 104 of the various tools. Of course, in other forms, instead of a pivot location, the lock members can be attached in other methods to provide an action by the operator to disengage the lock extension 78 from the various notches within the tool cam surface 104.

Figure 6A:
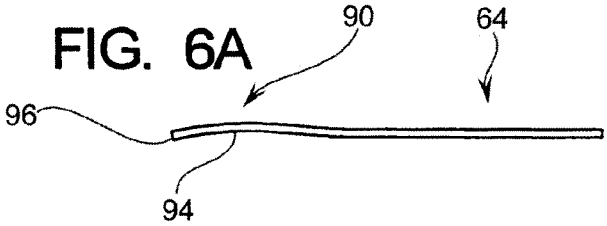
FIGS. 6A and 6B show front and top views of one form of a spring assembly.
Figure 6B:
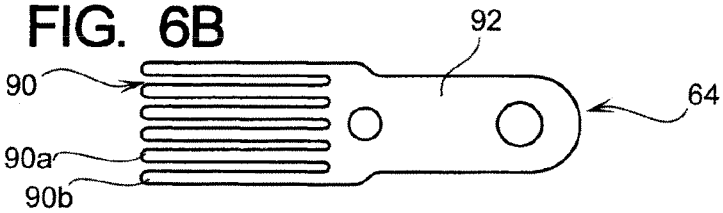

Referring now to FIGS. 6A and 6B, there is shown the spring assembly 64. In one form, the spring assembly 64 is a unitary structure which (as shown in FIG. 6B) comprises a plurality of spring members 90 and an attachment region 92. The attachment region 92 is adapted to be fixedly attached to the base portion 49 of the handle members, as shown for example in FIG. 3. Referring back now to FIGS. 6A and 6B, the lock member springs 90 in one form are cantilevered-like leaf springs where a majority of the flexion of the springs are independent from one-another. As can be further appreciated in description of the operations herein, two adjacent springs such as those shown at 90*a* and 90*b* operating independently can provide a biasing force to adjacent tool members. In other words, if one spring is flexed as the corresponding lock member presses thereagainst, an adjacent lock member will remain intact and engage the tool cam surface of its respective tool.

As shown in FIG. 6A, the cantilevered-like lock member springs 90 can have a contour generally indicated at 94. The springs 90 have a lock member engagement surface 96, which it is adapted to engage the spring engagement region 80 of the lock members 68.

Figure 7A:
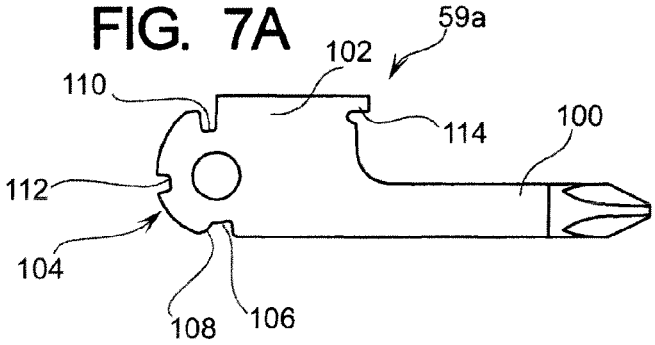
FIGS. 7A and 7B show side and front views of one example of a tool member.
Figure 7B:
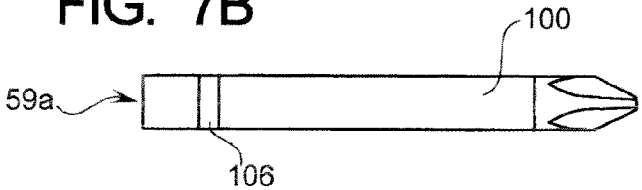

With the foregoing description in place with regard to the lock members and the lock member springs, there will now be a discussion of a tool member with reference to FIGS. 7A and 7B.

As shown in FIG. 7A, there is a tool member 59*a*. The tool member comprises an operating region 100 and a base region 102. Located in the base region is a tool cam surface 104. The tool cam surface 104 is sometimes referred to as the tang portion, particularly when dealing with blades. In general, the tool cam surface, which will be described in greater detail with the various notches and so forth, is configured to engage the lock extension 78 of the lock member 68 as shown in FIGS. 8-13 described further herein.

The tool cam surface 104 comprises a retaining notch 106. In one form, the retaining notch has a forward surface 108 which is angled in a forward direction at a sufficient slope such that as the forward portion of the lock extension 78 engages this region, this forward surface 108 will bias the lock extension of 78 in a transverse outward direction. Of course, in other forms, the surface 108 can be more radially aligned and have a steeper slope whereby the tool member is positively retained within the handle in a closed orientation.

As shown in FIG. 7A, the tool cam surface 104 further comprises a fully extended slot 110. In one form, the slot 110 is positioned substantially on the opposing side 180 degrees from the retaining notch 106. Of course, other notches such as the intermediate lock notch 112 can be positioned where a tool (such as the one shown in FIG. 7A) has a screwdriver and may be utilized extending at approximately 90 degrees from the longitudinal axis of one of the handles. The extraction surface 114 is generally provided in various forms to allow the tool member to be extracted from a handle.

Figure 8:
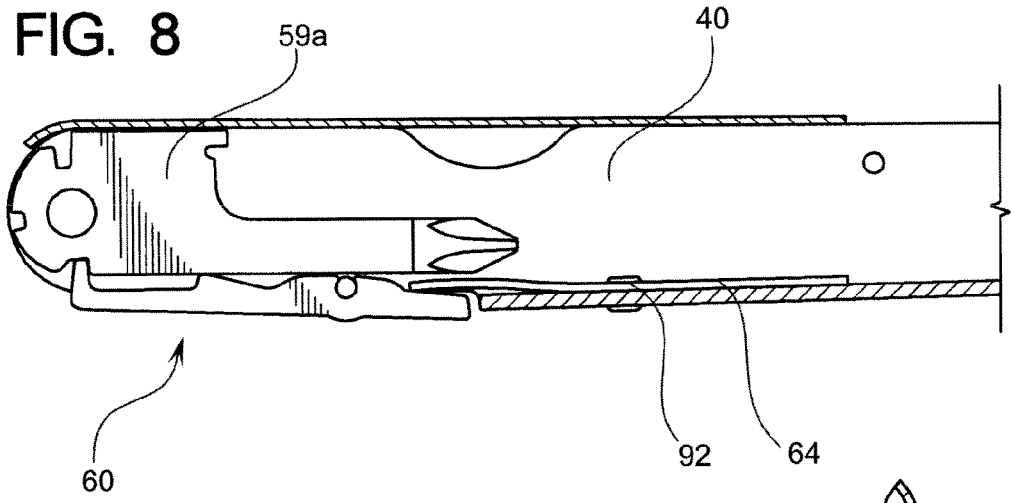
FIG. 8 is a partial sectional view taken along line 8-8 of FIG. 4 illustrating how the tool member is in a closed orientation with respect to the handle.
Figure 9:
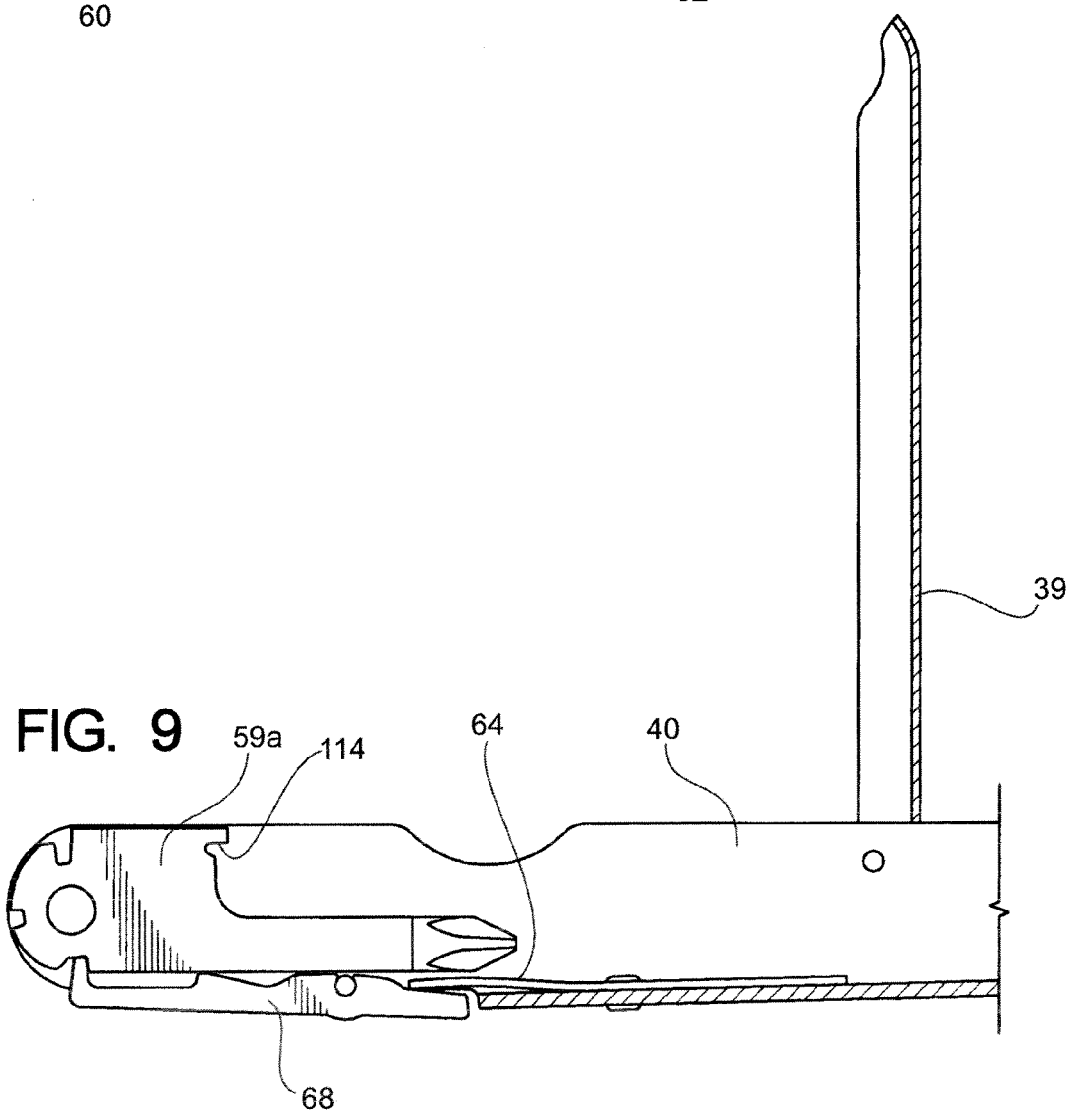
FIG. 9 shows one form where a tool handle cover is utilized.
Figure 10:
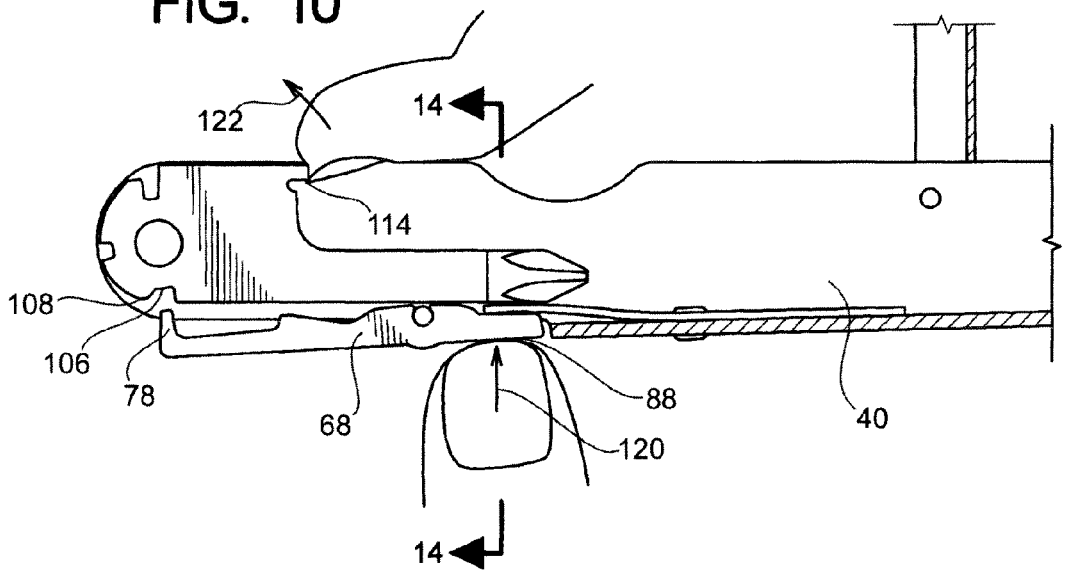
FIG. 10 shows one method of extracting a tool member from the handle.

Referring now to FIG. 8, there will be a discussion of the tool locking system 60. As shown in FIG. 8, it can be seen that the tool member 59*a* is in a retained orientation within the channel region of the handle member 40. Referring now to FIG. 9, it can be appreciated that the protective cover 39 in one form is retracted. Of course, in other forms, the cover 39 (and 41 as shown in FIG. 2) is not necessarily needed. Further, in other forms the locking system 60 can be positioned on the opposing transverse region of the handle member.

Figure 14:
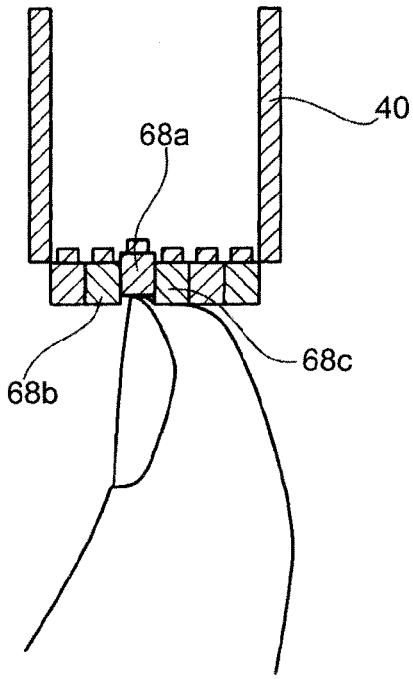
FIG. 14 schematically shows the method of disengaging the lock extension individually from a single tool member which may be interposed amongst other adjacent lock members, thereby not disrupting the locking or engagement of the lock member with the tool cam surface of adjacent tools.

As shown in FIG. 9, the cover 39 is repositioned and the extraction surface 114 is accessible. Now referring to FIG. 10, it can be seen how the user places a force 120 upon the release surface 88 and the lock extension 78 disengages from the retention slot 116 and the extracting force 122 is applied to the extraction slot 114. Of course, in one form, the forward surface 108 is sloped so it is not necessary in one form to press and reposition the lock member 62. Referring ahead to FIG. 14, it can be appreciated that a single lock member 68*a* can be depressed where adjacent lock members 68*b* and 68*c* maintain a force upon their respective tool members, which they engage.

Figure 11:
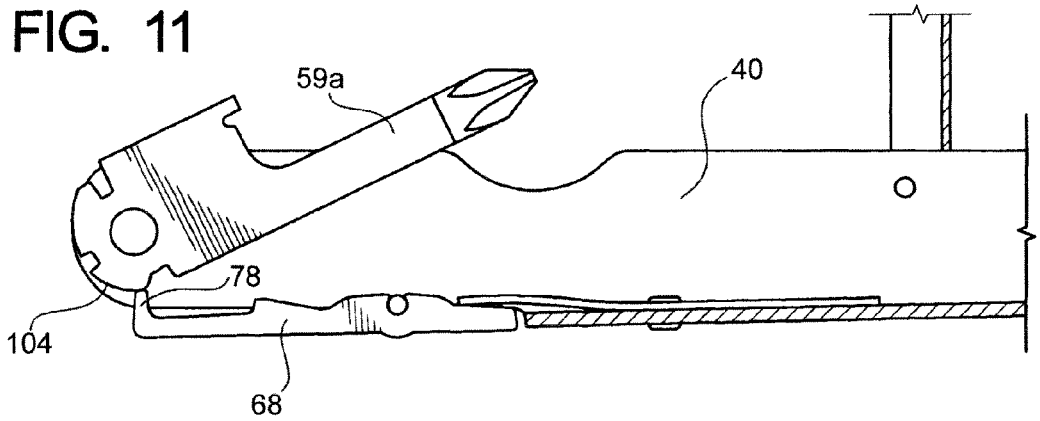
FIG. 11 shows the tool member being extracted whereby the lock extension of the lock member is engaging the tool cam surface and the lock members is in a higher stored energy state.
Figure 12:
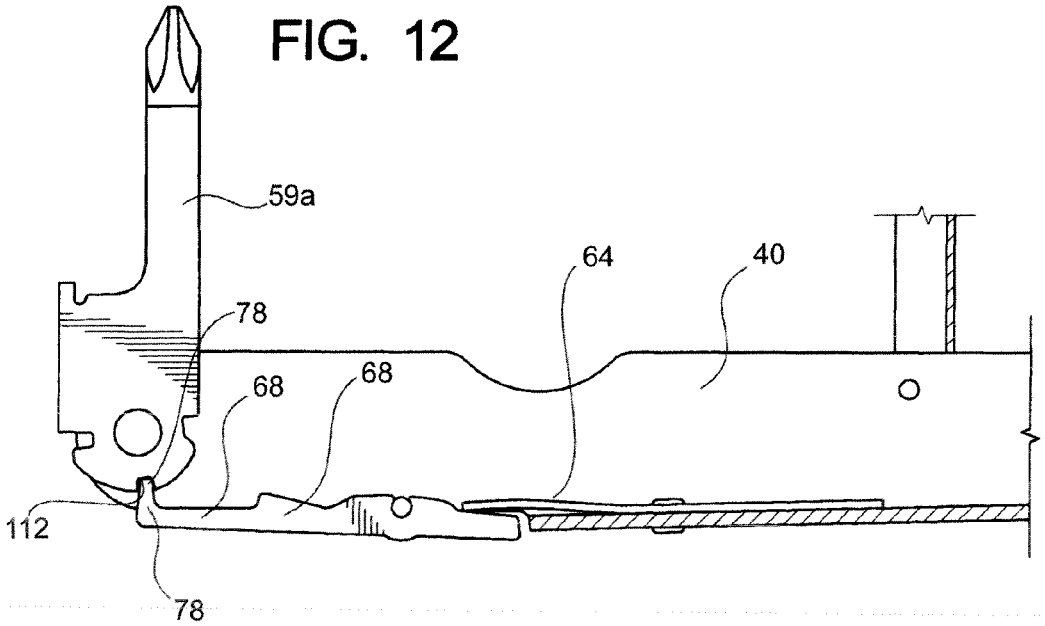
FIG. 12 shows one form where an intermediate locking notch can maintain a tool member locked in an intermediate location.

Referring now to FIG. 11, the lock extension 78 is engaging the tool cam surface 104 at a region where the tool member 59*a* can be easily repositioned. As shown in FIG. 12, in one form, intermediate notches such as that shown at 112 can engage the lock extension 78 and retain the tool member 59*a* in this orientation.

Figure 13:
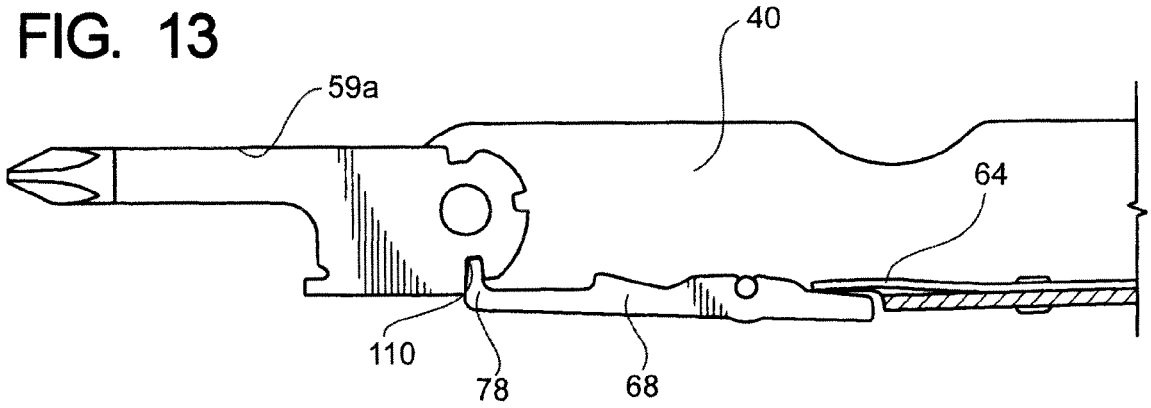
FIG. 13 shows the tool member locked in a fully extended orientation.

Referring now to FIG. 13, I can be appreciated that the tool member 59*a* can be in a fully extended orientation where the extension 78 of the lock member 60 is engaged within the fully extended slot 110.

Again referring to FIG. 14, it should be noted that that the discrete locking members allow for the user to unlock one tool member while the adjacent tool members can remain locked or substantially locked if an angled surface 108 is employed. Of course, the tool members can have a variety of widths where the particular tool member 59*a* as shown in FIG. 7B is somewhat wider where this particular tool member is a Phillips head screwdriver. Therefore, in one form, either one or two larger lock members 66 such that shown in FIG. 4 would be utilized.

Figure 15:
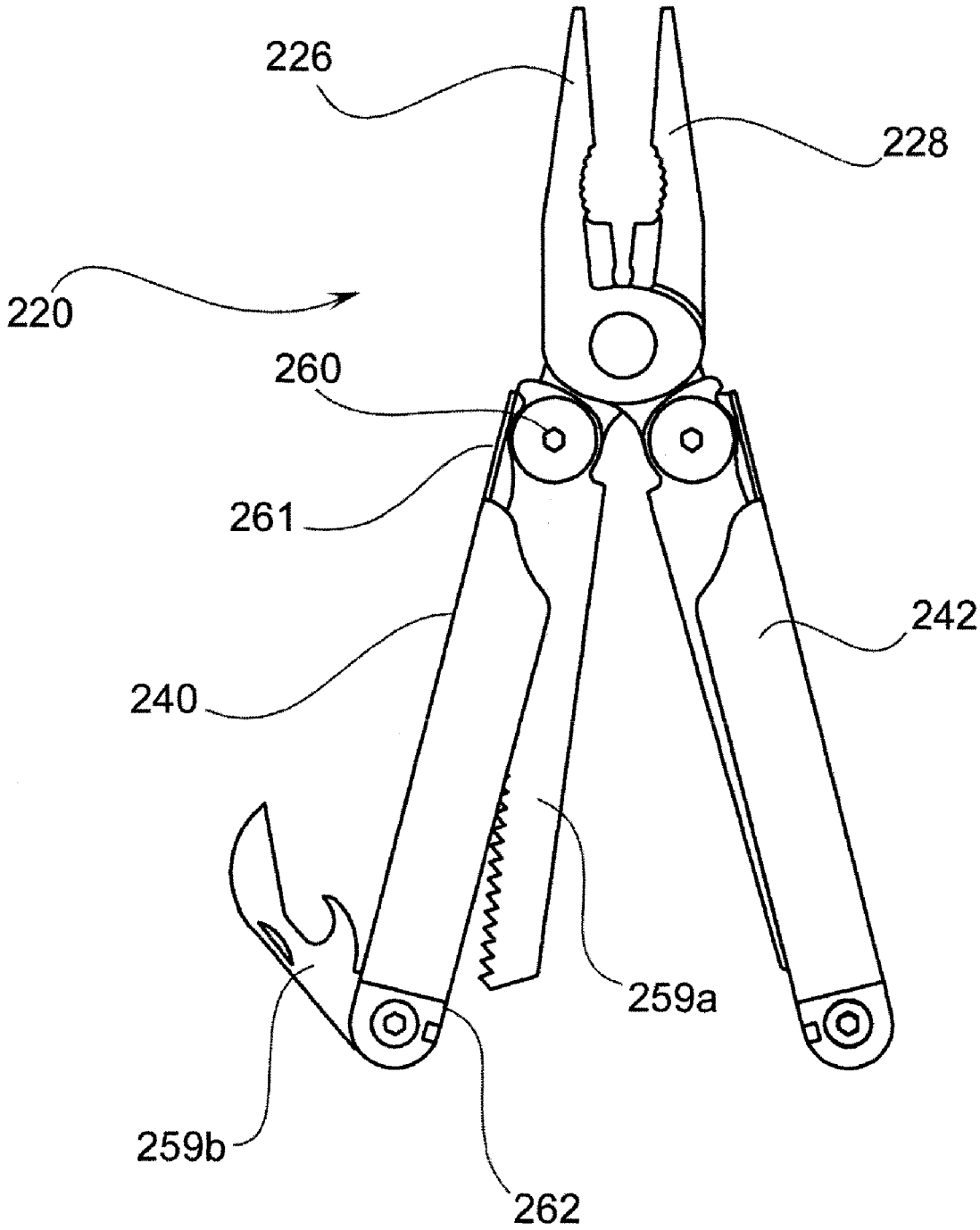
FIG. 15 shows an alternative embodiment of which the locking system can be utilized.

As shown in FIG. 15, there is another embodiment 220 where the jaw members 226 and 228 are attached to the handle members 240 and 242 by a more conventional method of attachment. FIG. 15 shows an alternative arrangement of the tool members where, for example, the tool members 259*a* and 259*b* are attached at various locations on the handle 240. In one form, the tool member 259*a* is attached at the pivot region 260. A locking mechanism similar to that described above can be attached at the location generally indicated at 261 or 262. For example, additional tools that are also pivotally attached near the tool 259*b* can have a plurality of lock members individually locking each tool member.

It should be further noted that the discrete locking members could be utilized for a conventional knife as well as a multitool. For example, the member as shown in FIG. 8 could be simply a knife member as opposed to a handle member of a multitool. Although FIG. 14 shows engagement of a singular lock member 68*a*, in practice, the adjacent lock members 68*b* and 68*c* can be pressed as well such that there is no segregating member adjacent to the various lock members in one form. This allows for a workable ergonomic system where adjacent tool members can be partially depressed, but with a concave-like pressing surface such as the tip of a finger, the adjacent lock members may not necessarily disengage from locking their associated tools. Present analysis indicates that there is a tactile desirable feel involved in pressing the keys individually, and further, the operator can be selective regarding how many lock members to engage in any given time.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A multi-tool comprising:

a. jaw region with first and second jaw members, a first pivot swingably connecting the jaw members for movement relative to each other, each of the jaw members having a working end portion extending from the first pivot in a first direction and a tail portion extending from the first pivot in a second, generally opposite direction, b. first and second handle members each having a channel region defined by a base portion and first and second lateral wall members where the jaw members being moveable relative to the handles between an open position in which the jaw member working end portions are exposed and a closed position in which the jaw members are substantially nested in the channels of the handles, the channel regions of the handles opening outward, away from each other, when the handles are in the open position, c. first and second tool members pivotally attached to the first handle member, each tool member having an outer region and an attachment region, where located at the attachment region is a tool cam surface comprising a retaining surface and a lock member surface, d. a tool member locking system comprising at least two adjacent first and second lock members attached to the first handle member, each lock member comprising a unitary structure, each lock member having a lock extension operatively configured to engage the tool cam surface of the first and second tool members positioned adjacent to one another where the lock extension of the lock member engages the retaining surface to retain the tool member in a retained position within the central region of the first handle member, the lock extension also operatively configured to engage the lock member surface to lock the tool member to an extended orientation and the adjacent first and second lock members are unobstructed therebetween to allow simultaneous depression thereof, e. a spring assembly comprising first and second lock member springs of substantially equal length and not extending to the either end of the handle member and configured to engage the first and second lock members to forcefully bias the lock extension toward the retaining surface of each respective separate adjacent first and second tool members where the spring assembly comprises an attachment region where the attachment region and the first and second lock member springs are a unitary structure and the attachment region is fixedly attached to the base portion of the first handle member.

2. The multi-tool as recited in claim 1 where the retaining surface and the lock member surfaces are notches extending radially inwardly from the adjacent tool cam surface.

3. The multi-tool as recited in claim 2 where the retaining surface comprises a forward surface that is angled so the tool member can be extracted by way of placing a force on an extraction surface and the retention surface repositions the lock extension in a transverse outward direction.

4. The multi-tool as recited in claim 1 where a spring assembly is attached to the first handle member and the spring assembly comprising first and second spring members each engaging the first and second lock members to bias the lock extension to the tool cam surface the spring assembly.

5. The multi-tool as recited in claim 4 where the first and second spring members are cantilevered springs.

6. The multi-tool as recited in claim 5 where a substantial amount of the spring action for the first and second lock members from the spring assembly is from two independent lock member springs attached to a base region of the spring assembly.

7. The multi-tool as recited in claim 1 where the tool cam surface defines an intermediate lock notch to position an outer region of the first tool member in a locked orientation between an extended orientation and the retained orientation.

8. The multi-tool as recited in claim 7 where the intermediate lock notch positions the outer portion of the first tool member at a substantially orthogonal orientation with respect to the first handle member.

9. The multi-tool as recited in claim 1 where the first and second lock members comprise a lock body having a spring engagement region configured to respectively engage the first lock member spring and the second lock member spring.

10. The multi-tool as recited in claim 1 where when the first lock member is biased against an engagement surface and the lock extension of the first lock member disengages from the retaining surface of the first tool member, the lock extension of the second lock member maintains engagement with the retention surface of the second tool member where when the first tool reorientates from a retained orientation to an extended orientation with friction occurring between the first and second tool members.

* * * * *